United States Patent [19]

Dugan

[11] 3,950,019

[45] Apr. 13, 1976

[54] CHAIN DOOR FASTENER

[76] Inventor: Thomas J. Dugan, 2501 El Camino Real, No. 206, San Clemente, Calif. 92672

[22] Filed: Apr. 5, 1974

[21] Appl. No.: 458,116

[52] U.S. Cl. ..... 292/264; 70/93

[51] Int. Cl.[2] ..... E05C 17/36

[58] Field of Search..... 292/264, DIG. 41, DIG. 44, 292/DIG. 60; 70/93

[56] References Cited

UNITED STATES PATENTS

| | | | |
|---|---|---|---|
| 1,575,429 | 3/1926 | Lawrence | 292/264 |
| 1,850,367 | 3/1932 | Winter | 292/264 |
| 3,762,752 | 10/1973 | Saunders | 292/264 |

FOREIGN PATENTS OR APPLICATIONS

| | | | |
|---|---|---|---|
| 357,075 | 8/1922 | Germany | 292/264 |
| 9,223 | 11/1897 | United Kingdom | 292/264 |

*Primary Examiner*—Robert L. Wolfe
*Assistant Examiner*—Carl F. Pietruszka
*Attorney, Agent, or Firm*—Boniard I. Brown

[57] ABSTRACT

A conventional chain door fastener is provided with an additional second stage lock arrangement for maintaining the chain fixed taut between the trim plate member on the door jamb and the door plate member on the door. Preferably, the arrangement includes a slide member adapted to be removably secured on the slideway of the door plate member.

2 Claims, 5 Drawing Figures

FIG. 1.
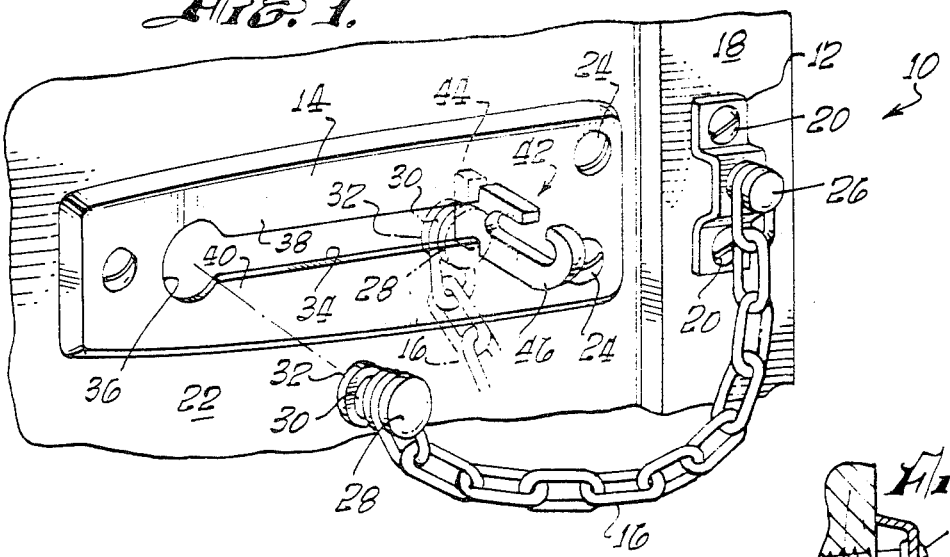
FIG. 2.
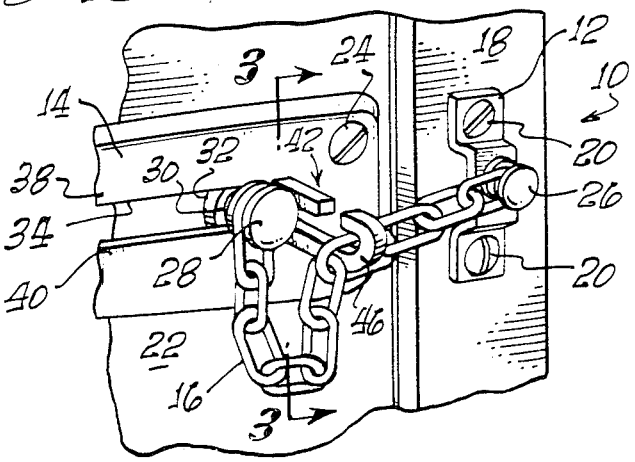
FIG. 3.
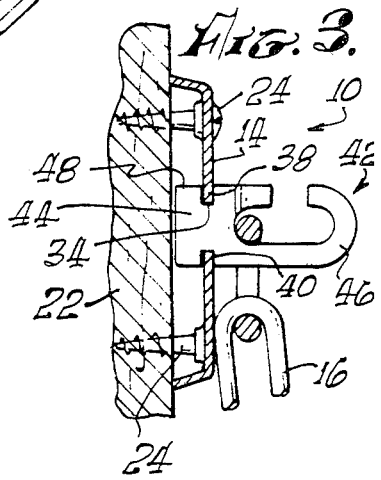
FIG. 4.
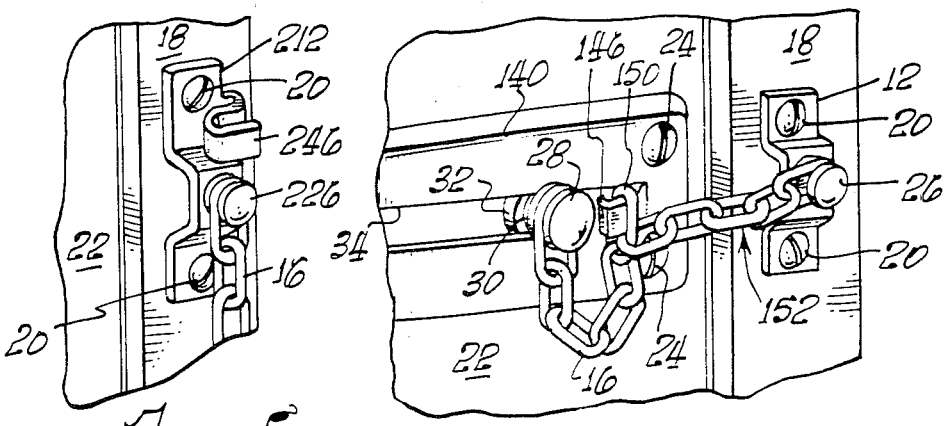
FIG. 5.

CHAIN DOOR FASTENER

BACKGROUND OF THE INVENTION

1. Field of the Invention

This invention pertains generally to security guard devices, and is particularly concerned with devices of the type widely known in the trade as chain door fasteners.

2. Description of the Prior Art

Chain door fasteners of the prior art are conventionally comprised of a trim plate member adapted to be secured by screws to the jamb of a door frame, and a door plate member adapted aslo to being secured by screws to a door so as to be adjacent the trim plate member when the door is closed. A short length of chain, usually about 6 inches long, has one end swively coupled to the trim plate member, the other end of the chain being provided with a plug like element which is removably securable on the door plate member by means of a slideway slot defined by the latter member.

The plug element is received in an enlarged opening at one end of the slideway, and is thereupon slidable in the slot to the other end thereof whereat it is secure against removal from the door plate member. This arrangement provides a measure of security under circumstances where it is desired to open the door slightly (about 2½ maximum) for ventilation or for checking the identity of a person on the other side of the door.

However, the security may be largely false in the case of an outsider determined to break in. If the door is already opened as aforesaid, it is a simple matter to insert a bolt cutter, or the like, through the narrow opening to sever the chain. In the event that cutting of the chain is frustrated, a determined intruder may likely effect entry by breaking in by impact force applied by his body to the side of the door adjacent the area of the chain door fastener. This is possible because the impact force jerks the chain out from the jamb. As a consequence of this the force is transmitted by the chain to the trim plate member in a direction which is substantially along the axis of the wood screws holding the plate on the jamb, and this is the weakest holding force direction of the usual wood screws employed.

SUMMARY OF THE INVENTION

It is a general object of the invention to provide an improved chain door fastener with a second stage lock arrangment providing means for removably securing a link of the chain intermediate the ends thereof, to one of the plate members. It is another object of the invention to provide means on the door plate member of a chain fastener device, for removably securing a link intermediate the chain ends. It is yet another object to provide means on the trim plate member for removably securing a chain link as aforesaid.

It is a further object of the invention to provide means on a chain door fastener for removably securing a link intermediate the chain ends, characterized in that the securing means is removably securable on one of the plate members. Yet a further object is to provide such a means removably secureable on the door plate member. It is a still further object to provide means as aforesaid which comprises a slide member cooperably slidable with the slideway portion of the door plate member. It is yet a further object to provide such a means with a slidable notched portion cooperable with the slideway, and a hook portion integral with and extending from the notched portion to receive a link of the chain. Yet a still further object of the invention is to provide a secondary lock arrangement for chain door fasteners comprising a small, compact, light weight member readily carried by travelers and adapted to use in connection with substantially all such fasteners currently installed in nearly all hotels, motels, and the like, the secondary lock member being easily removed and carried in the traveler's luggage or in his pocket or on his person in a pocketbook or the like.

Other and further objects of the invention will be apparent upon consideration of the drawing when considered in connection with the description thereof hereinbelow.

BRIEF DESCRIPTION OF THE DRAWINGS

FIG. 1 is a perspective view showing a preferred form of the invention in use;

FIG. 2 is a view similar to FIG. 1 showing the parts of the invention cooperatively disposed in secondary lock disposition;

FIG. 3 is a cross section side elevation view taken on the line 3—3 of FIG. 1;

FIG. 4 is a view similar to FIG. 2, illustrating another embodiment of the invention; and FIG. 5 is a fragmentary perspective view showing a form of trim plate used in yet another embodiment of the invention.

DESCRIPTION OF THE PREFERRED EMBODIMENTS

Referring to FIG. 1 there is shown a chain door fastener 10 having plate members 12 and 14 and a door chain member 16. Plate 12 is a trim plate member secured on a door jamb, a fragmentary portion of which is shown at 18, by screws 20. Plate 14 is a door plate member secured on a door, a fragmentary portion being indicated at 22, by screws 24. Chain member 16 has one end swively coupled to the trim plate 12 by means of a stud 26 secured thereon. The other end of the chain 16 is provided with a plug like slide member 28 defining a recessed annular groove 30 bounded on one side by a button like portion 32 of the member 28.

The door plate member 14 defines a keyhole configured slot having an elongated slideway slot 34 enlarged at one end to provided an opening 36 adapted to pass the button 32 of the member 28 therethrough, whereafter the member 28 may be slid along the opening 36 with adjacent edges 38 and 40 of slot 34 engaging the annular groove 30 of the member 28. As will be evident, when the member 28 is slid to the right along the slot 34 as aforesaid, the chain 16 will droop somewhat until the member 28 reaches the end limit of travel at the extreme right end of the slot. In this condition the fastener 10 is performing its security function of holding the door against entry of unwanted person, yet permitting the door to be opened slightly about 2½ for ventilation or identification of outsiders. When so opened, the chain 16 is stretched out straight to take up the droop.

The structure and function as aforesaid is well known in the prior art, and need not be explained further in greater detail. The improvement of the present invention starts from such prior known art, and will now be described. Whereas the prior art has stopped at a single stage of security, the present invention provides a second stage of security, the present invention provides a second stage of distinct advantage. To this end there is provided means on one of the plate members for removably securing thereto the door chain intermediate its ends. In the embodiment of FIGS. 1–3, the means for removably securing the chain 16 comprises a slide member 42 which is prefably shaped substantially as shown for a purpose which will be disclosed. Preferably the member 42 is substantially of thick gauge block configuration having a notched portion 44 integral with a hook portion 46 extending outwardly therefrom, all as best seen in FIG. 3. The notched portion 44 comprises a button like end 48, similar in some respects to the button like portion 32 on the slide member 28, in that it is adapted to pass through the enlarged opening 36 of the slideway 34. The notched portion 44 further defines notched grooves adapted to receive the slot edges 38 and 40 in slidable relationship, whereby the slide member 42 may removably secured to the door plate member 14 after the end 48 is received through the opening 36 and the member 42 thereafter slid to the right as seen in FIGS. 1 and 2.

In use the slide member 42 is disposed on the door plate member 14 as aforesaid, being slid as far to the right end of the slideway 34 as possible, substantially as shown in FIGS. 1 and 2. Thereafter, the chain 16 is stretched to the left as taut as may be, whereupon the link 50 (for example) is slipped over the hook portion 46, as best seen in FIGS. 2 and 3. If desired, the slide member 28 on the end of the chain 16 may thereafter be disposed on the plate member 14 as shown in FIG. 2, although this is merely added protection to that afforded by the slide member 42 which is providing the principal protection by maintaining the chain portion 52 (FIG. 2) taut and preventing opening of the door.

As will be apparent, if any attempt is made to force the door open, the taut chain portion 52 between the slide member 46 and the trim plate 12 transmits transverse sheer forces to the screws 20 and 24, which are more readily resistant than are the tension forces usually applied along the axes of screws 20, since these latter type forces are not substantially resisted by the wood frame members such as the jamb 18 in which the screws 20 are disposed.

It will be apparent also that the slide member 42 may be disposed in the slideway 34 on either side of the slide member 28. Thus, it may be disposed firstly, as shown in FIGS. 1–3, or after the chain slide member has been disposed on the plate member 14. In the latter case a longer taut chain portion between the stud 26 and the hook portion 46 would be necessary.

It should be noted that the end 54 of hook portion 46 extends a substantial distance in a reversely directed manner towards the notched portion 44 to defeat any attempt to remove the link 50 from the hook 46 by a thin jimmy or blade which an intruder might by some chance be able to slip through between the jamb and the closed door.

Another embodiment of the invention is depicted in FIG. 4, wherein the door plate member 140 is provided with means for removably securing a link of the chain, comprising the hook element 146 formed of a stamped or struck out portion of the plate 140, whereafter the link 150 of the chain member 16 may be disposed over the hook 146 with the portion 152 of the chain substantially taut between the stud 26 of the trim plate 12 and the hook 146 of the door plate 140. Here, again, the slide member 28 on the end of the chain 16 may be disposed on the plate 140 as shown in FIG. 4, or may be left hanging down.

Yet another embodiment of the invention is depicted in FIG. 5. In this embodiment, the means for removably securing the door chain intermediate its ends comprises a hook element 246 formed as an integral stamped portion of the trim plate member 212 which is provided with a stud 226 similar to the stud 26 on the trim plate member 12 of FIGS. 1 and 2. One end of the chain 16 is swively coupled to the stud 226, in the same manner as the chain and stud coupling of FIGS. 1 and 2. The other end of the chain 16 is provided with a slide member (not shown) similar to the slide member 28 of FIGS. 1 and 2, arranged to cooperate with a door plate member (not shown) which is also similar to the door plate member 14 of FIGS. 1 and 2.

In the case of this last mentioned embodiment, the practice of the invention is effective after the door is closed by securing the slide member on the end of the chain to the door plate member in the usual manner. The chain 16 is then drawn taut to the right side from the slide member, after which the adjacent link of the chain is drawn over the hook element 246 to retain the chain taut between the hook 246 and the slide member.

The inventor claims:

1. A door chain latch comprising:

a. first and second plate members to be mounted on a door and the jamb portion of the door frame, respectively;

b. a latch chain;

c. means fixedly securing one end of said chain to one of said plate members;

d. means releasibly securing the other end of said chain to the other plate member comprising a stud on said chain and a slideway in said other plate member for removably slidably receiving said stud; and e. hook means having a portion removably slidably engageable in said slideway before said stud and having a hook portion insertable through a selected intermediate link of said chain.

2. The latch of claim 1 in which said one plate member is a trim plate for mounting on said door frame jamb portion, said other of said plate member is a door plate for mounting on said door, and said one chain end is secured to said trim plate.

* * * * *